US012774558B2

(12) United States Patent
Nicholson

(10) Patent No.: US 12,774,558 B2
(45) Date of Patent: Oct. 27, 2026

(54) BLACK LIQUOR TREATMENT

(71) Applicant: SOLENIS TECHNOLOGIES, L.P., Wilmington, DE (US)

(72) Inventor: Daniel Joseph Nicholson, Swarthmore, PA (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 193 days.

(21) Appl. No.: 18/490,110

(22) Filed: Oct. 19, 2023

(65) Prior Publication Data

US 2024/0150960 A1 May 9, 2024

Related U.S. Application Data

(60) Provisional application No. 63/380,809, filed on Oct. 25, 2022.

(51) Int. Cl.
*D21C 11/00* (2006.01)
*D21C 11/10* (2006.01)

(52) U.S. Cl.
CPC ..... *D21C 11/0092* (2013.01); *D21C 11/0057* (2013.01); *D21C 11/10* (2013.01)

(58) Field of Classification Search
CPC .. D21C 11/0092; D21C 11/0057; D21C 11/10
See application file for complete search history.

(56) References Cited

U.S. PATENT DOCUMENTS 2,871,155 A * 1/1959 Vellaire ..... A01N 25/24 106/123.13
3,361,556 A * 1/1968 Luckenbaugh ..... A01N 47/20 504/304
4,776,889 A 10/1988 Diep et al.
5,417,891 A 5/1995 Gomes et al.
5,527,427 A 6/1996 Berksoy et al.
5,635,027 A 6/1997 Spontak et al.
6,107,261 A 8/2000 Taylor et al.
2004/0176480 A1 9/2004 Dyllick-Brenzinger et al.
2007/0289071 A1 12/2007 Smith et al.
2008/0277083 A1* 11/2008 Shevchenko ..... D21C 9/008 162/49
2009/0306282 A1* 12/2009 Hilberer ..... D21H 21/12 524/588
2014/0001421 A1 1/2014 Lockett et al.
2015/0191680 A1 7/2015 Kieffer et al.
2019/0270064 A1 9/2019 Postma
2019/0284505 A1 9/2019 Riehm et al.
2019/0291024 A1* 9/2019 Rahma ..... B01D 19/0409
2021/0062421 A1 3/2021 Pace et al.
2021/0176986 A1 6/2021 Hanson et al.
2022/0125046 A1 4/2022 Ji et al.

FOREIGN PATENT DOCUMENTS

AU 1003795 A * 8/1995 ..... D21H 21/02
JP 2012162975 A 8/2012
WO WO-2013043678 A1 * 3/2013 ..... A01N 25/30
WO 2019004076 A1 1/2019

* cited by examiner

*Primary Examiner* — Anthony Calandra

(74) *Attorney, Agent, or Firm* — Ingrassia Fisher & Lorenz LLP

(57) ABSTRACT

Compositions and methods for minimizing fouling and/or reducing the viscosity of black liquor in a Kraft pulping process are provided. An exemplary composition includes an anionic sulfate or sulfonate surfactant; an anionic sulfate or sulfonate dispersant; and a nonionic alkoxylated surfactant.

13 Claims, 5 Drawing Sheets

BLACK LIQUOR TREATMENT

CROSS-REFERENCE TO RELATED APPLICATION

This application claims the benefit of U.S. Provisional Application No. 63/380,809, filed Oct. 25, 2022, which is hereby incorporated in its entirety by reference.

TECHNICAL FIELD

Embodiments described herein relate to compositions and methods for minimizing fouling and/or reducing the viscosity of black liquor in a Kraft pulping process.

BACKGROUND

The Kraft process is the dominant pulping method in the pulp and paper industry. Spent liquor resulting from the Kraft pulping process (black liquor or "BL") contains various organic materials as well as inorganic salts, the deposition of which detracts from an efficient chemical recovery cycle. Inorganic pulping chemicals and energy are recovered by incinerating BL in a recovery boiler. For an efficient combustion in the recovery furnace, BL coming from the pulp digesters with relatively low solids concentration has to be evaporated and concentrated to at least 60% solids, typically in a multistage process (i.e., a multi-effect evaporator).

Kraft pulp mill evaporator systems can be the bottleneck in chemical recovery limited mills. Black liquor evaporation is accomplished in multiple effect evaporator trains, in which steam heat is applied to one side of a tubular or lamellar surface and water is evaporated out of the BL on the other side. The efficiency of this heat transfer is often measured by the difference in temperature on the two sides or $\Delta T$, which increases as fouling occurs. If the fouling is minimized and/or the solution viscosity is lowered, this $\Delta T$ remains low and efficiency is maintained. If the solution thickens or the surfaces foul, the $\Delta T$ rises, more steam is consumed for the same amount of evaporation, and at a certain point the evaporator must be taken off-line and cleaned. All evaporator effect cleaning cycles are performed offline in a few hours, but require the entire train to be throttled back to handle less liquor to make up for the missing effect. This requires the production of pulp to be dialed back, a loss that can be quantified for a value proposition.

Fouling can be caused by water soluble scale, sticky organic materials, and fiber that passes through unscreened. The scale is mostly sodium salts $Na_2SO_4$ and $Na_2CO_3$ that are heavily loaded in the liquor as it is concentrated by evaporation up to 50+% in the evaporator train before transfer to a concentrator. Sticky materials can be formed from the degraded lignin, sugars derived from cellulose/hemicellulose, and wood extractives (pitch, fats, resins). Unscreened fibers can be passed into the black liquor through broken screen sections.

Accordingly, it is desirable to provide a composition and method for improving the performance of a Kraft pulping process. Further, it is desirable to provide a composition and method for controlling the $\Delta T$ rise (heat transfer efficiency loss) over time by lowering viscosity and/or minimizing fouling, decreasing the viscosity of the solution, decreasing the differential pressure in a pipe in which the solution is pumped, and/or decreasing the rate of scale formation on an evaporator surface. Furthermore, other desirable features and characteristics of the present disclosure will become apparent from the subsequent detailed description and the appended claims, taken in conjunction with the accompanying drawings and this background.

BRIEF SUMMARY

Compositions and methods for treating black liquor are provided. In an exemplary embodiment, a composition includes an anionic sulfonate surfactant, an anionic sulfonate dispersant, and a nonionic ethoxylated surfactant.

In certain embodiments of the composition, the anionic sulfonate surfactant is selected from sodium xylene sulfonate and di-phenyl sulfonate gemini surfactant. Further, in certain embodiments, the anionic sulfonate surfactant is an alkyldiphenyloxide disulfonate.

In certain embodiments, the anionic sulfonate dispersant is a naphthalene sulfonate condensation polymer or a sodium lignosulfonate.

In certain embodiments, the nonionic ethoxylated surfactant is selected from ethylene oxide-propylene oxide (EO/PO) block copolymer surfactants, EO/PO/EO block copolymer surfactants, and linear ethoxylate [castor] oil.

In certain embodiments, the nonionic ethoxylated surfactant is a glycerol initiated EO/PO side chain surfactant.

In certain embodiments, the anionic sulfonate surfactant is an alkyldiphenyloxide disulfonate, the anionic sulfonate dispersant is a naphthalene sulfonate condensation polymer, and the nonionic ethoxylated surfactant is a glycerol branched EO/PO side chain surfactant.

In certain embodiments, the composition consists essentially of carbon atoms, hydrogen atoms, oxygen atoms, sulfur atoms, and sodium atoms. In certain embodiments, the composition consists of carbon atoms, hydrogen atoms, oxygen atoms, sulfur atoms, and sodium atoms, i.e., no atoms other than carbon, hydrogen, oxygen, sulfur, and sodium are present in the composition.

In certain embodiments, the composition is totally free of, essentially free of, and/or substantially free of certain non-desired compounds or anions. Non-desired compounds include nitrogen-containing compounds such as urea, alkyl amine, quaternary ammonium salt, or alkanolamine, phosphorus-containing compounds, such as vinyl phosphonate derived polymers or phosphonate chelants; glycols, such as ethylene-, diethylene-, and triethylene-glycol; and inorganic anions, such as aluminate, sulfite, bisulfate, thiosulfate, or thiocyanate. As used herein, for a composition that is "totally free of" a specified ingredient, the composition contains none of the ingredient; for a composition that is "essentially free of" a specified ingredient, the ingredient is not intentionally added to the composition"; and for a composition that is "substantially free of" a specified ingredient, the composition comprises less than 1 weight percent, such as less than 0.8 weight percent or less than 0.5 weight percent or less than 0.05 weight percent or less than 0.005 weight percent, of the ingredient based on the total weight of the composition.

In another exemplary embodiment, a composition includes water and active compounds. The active compounds include 0 to 90% by weight of an anionic sulfonate surfactant; 0 to 90% by weight of an anionic sulfonate dispersant; and 0 to 25% by weight of a nonionic ethoxylated surfactant, based on a total weight of the active compounds.

In certain embodiments, the composition includes from 40 to 80% by weight of the water; and from 20 to 60% by weight of the active compounds, based on a total weight of the composition.

In certain embodiments, the anionic sulfonate surfactant is an alkyldiphenyloxide disulfonate; the anionic sulfonate dispersant is a naphthalene sulfonate condensation polymer; and the nonionic ethoxylated surfactant is a glycerol branched EO/PO side chain surfactant.

In another embodiment, a method for treating a black liquor includes adding an effective amount of a composition to the black liquor; and minimizing fouling and/or reducing the viscosity of the black liquor, wherein the composition includes an anionic sulfonate surfactant; an anionic sulfonate dispersant; and a nonionic ethoxylated surfactant.

In certain embodiments, the method further includes passing the black liquor through a series of evaporators from a first evaporator to a last evaporator, wherein the effective amount of the composition is added to the black liquor in the last evaporator.

In certain embodiments, the effective amount of the composition is added to the black liquor when a solids concentration of the black liquor is from 40 to 60% by weight.

In certain embodiments, the effective amount of the composition is from 25 to 5,000 ppm, based on black liquor solids.

In certain embodiments, the black liquor has a pH of greater than 12, and wherein the black liquor is at a temperature of greater than 120° C.

In certain embodiments, the anionic sulfonate surfactant is an alkyldiphenyloxide disulfonate; the anionic sulfonate dispersant is a naphthalene sulfonate condensation polymer; and the nonionic ethoxylated surfactant is a glycerol branched EO/PO side chain surfactant.

In certain embodiments, the composition consists essentially of carbon atoms, hydrogen atoms, oxygen atoms, sulfur atoms, and sodium atoms.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
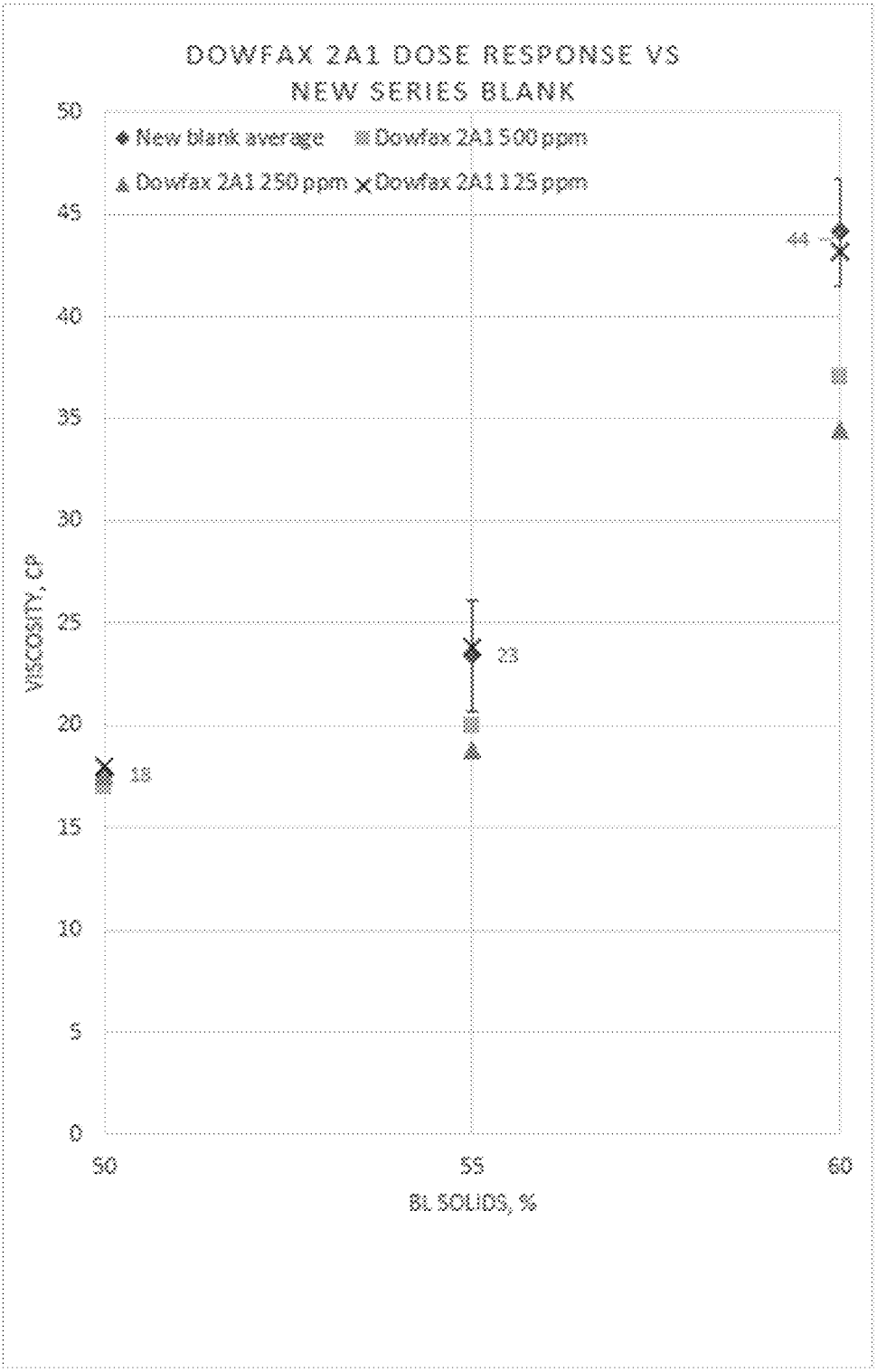
FIG. 1 is a graph illustrating a reduction in viscosity of a black liquor when treated with an anionic surfactant such as a sodium tetrapropyl diphenyloxide disulfonate.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

As used herein, "a," "an," or "the" means one or more unless otherwise specified. The term "or" can be conjunctive or disjunctive. Open terms such as "include," "including," "contain," "containing" and the like mean "comprising." The term "about" as used in connection with a numerical value throughout the specification and the claims denotes an interval of accuracy, familiar and acceptable to a person skilled in the art. In general, such interval of accuracy is ± ten percent. Thus, "about ten" means nine to eleven. All numbers in this description indicating amounts, ratios of materials, physical properties of materials, and/or use are to be understood as modified by the word "about," except as otherwise explicitly indicated. As used herein, the "%" described in the present disclosure refers to the weight percentage unless otherwise indicated.

As described herein, treatment compositions and methods are provided for increasing the efficiency, and reducing the cost, of a Kraft pulping process. In the process, Kraft black liquor is concentrated in a series of evaporators or evaporator stages, by evaporating water out of the black liquor. Typically, the last evaporator or evaporator stage (in the direction of black liquor flow) experiences high viscosity and increased fouling. Methods herein provide for adding a treatment composition to the black liquor at the last evaporator. Typically, the black liquor is from 50 to 60% solids at the point of addition.

The treatment composition includes a combination of surfactant and dispersant components. For use in the Kraft pulping process, the composition components must be active in harsh chemical conditions and be appropriate for use in a process stream that will be incinerated and subject to strict environmental regulation.

Addition of the described treatment composition provides an economic savings to the pulping mill (an energy savings value proposition) as well as decrease evaporator cleaning cycles (an increased production value proposition).

In an exemplary embodiment, the treatment composition decreases black liquor viscosity by greater than 15%, decreases the electrical pumping energy required to circulate the black liquor through the evaporator by lowering wall friction, decreases scaling propensity, and/or extends the time between evaporator effect cleanings by 15% or more.

In an exemplary embodiment, the composition components tolerate high temperatures, such as a temperature of 125° C., and high pH, such as a pH of 13, without decomposing.

In an exemplary embodiment, the composition components include only carbon, hydrogen, oxygen, sulfur, and sodium atoms. Thus, the composition components are compatible with pulp mill recovery boiler incineration and pollution control equipment. In certain embodiments, the black liquor includes only carbon, hydrogen, oxygen, sulfur, and sodium atoms. Thus, the treatment composition does not introduce any novel atoms to the black liquor. In other words, the composition components are formed from elements that are already present in the black liquor. As a result, no new post-evaporator processing is needed to remove compounds, atoms, or ions that are introduced to the black liquor by the treatment composition described herein.

Anionic Surfactant

An exemplary treatment composition includes a strongly anionic surfactant. The anionic surfactant is a hydrophobic chain comprised of an alkane, covalently bonded to an atom or group containing a formal negative charge. In certain embodiments, the strongly anionic surfactant is an anionic sulfonate surfactant. An exemplary anionic surfactant is a sodium sulfate or a sodium sulfonate surfactant. Exemplary sodium surfactants include, without limitation, sodium alkyl sulfates, sodium polyoxyethylene sulfates, sodium lauryl ether sulfates, sodium polyoxyethylene lauryl ether sulfates, sodium lauryl sulfates, sodium alkyl sulfonates, sodium alkyl ether sulfonates, sodium alkylbenzene sulfonates, sodium linear alkylbenzene sulfonates, sodium alpha-olefin sulfonates, sodium alcohol polyoxyethylene ether sulfonates, sodium dioctyl sulfosuccinates, and sodium dioctyl sulfosuccinates.

In certain embodiments, the anionic surfactant may be an alkylaryl sulfonate surfactant, alkyl sulfonate surfactant, alkyl ether sulfonate surfactant, alpha olefin sulfonate surfactant, paraffin sulfonate surfactant, or alkenyl sulfonate surfactant including, for example, sodium octadecylphenyl sulfonate, sodium xylene sulfonate, sodium (C14-C16)alpha olefin sulfonate, sodium tridecyl benzene sulfonate, and sodium dodecyl benzene sulfonate, or disodium alkyldiphenyloxide disulfonate. An exemplary anionic surfactant is sodium xylene sulfonate.

In certain embodiments, the anionic surfactant may be a gemini surfactant, for example a di-phenyl sulfonate gemini surfactant.

In certain embodiments, the anionic surfactant may be selected from sulfosuccinates such as dioctyl sulfosuccinate. For example, the anionic surfactant may be selected from sodium sulfosuccinates and esters thereof, e.g., dioctyl sodium sulfosuccinate, alkyl (C6-C18) sulfonic acid sodium salts, and the di-anionic sulfonate surfactants.

Exemplary anionic surfactants include alkyldiphenyloxide disulfonate, such as a diphenyloxide disulfonate, for example a sodium alkyl diphenyloxide disulfonate. An exemplary anionic surfactant may be selected from the DOWFAX line of anionic surfactants available from Dow Chemical, including DOWFAX 2A1 (sodium tetrapropyl diphenyloxide disulfonate), DOWFAX 3A2, DOWFAX 8390, and DOWFAX C6L (alkyldiphenyloxide disulfonate), as well as RHODACAL DSB available from Rhone-Poulenc, POLY-TERGENT 2A1, POLY-TERGENT 2EP available from Olin, AEROSOL DPOS-45 available from Cytec, CALFAX DBA-40, CALFAX 16L-35 available from Pilot Chemicals, and the like. Diphenyloxide disulfonate surfactants represent a class of highly anionic surface active agents consisting of disulfonated alkyl diphenyl oxide molecules in which the charge arises from two sulfonate groups and provides excellent emulsion stability.

In certain embodiments, the anionic surfactant is a C6-C20 alkyl sulfate, a C6-C20 alkyl ether sulfate, a C6-C20 alkyl sulfonate, and/or a C6-C20 alkyl ether sulfonate. Examples of suitable C6-C20 alkyl sulfates and alkyl ether sulfates are sodium salts of decyl sulfate, lauryl sulfate, and stearyl sulfate. Examples of suitable C6-C20 alkyl sulfonates and alkyl ether sulfonates are sodium salts of decyl sulfonate, lauryl sulfonate and stearyl sulfonate. An example of a suitable C6-C20 alkyl benzenesulfonate is sodium dodecylbenzene sulfonate. An example of a suitable diphenyl oxide disulfonate is sodium dodecyl diphenyl oxide disulfonate (like Dowfax® 2A1).

An exemplary sodium alkyl diphenyloxide disulfonate has the formula (I):

(I)

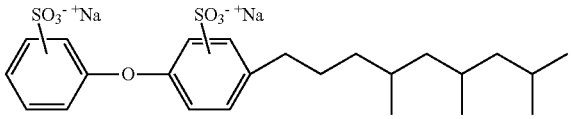

In certain embodiments, the treatment composition may include a single anionic surfactant. In other embodiments, the anionic surfactant may include a combination of more than one anionic surfactant.

In an exemplary embodiment, the treatment composition includes at least 1% of the anionic surfactant, such as at least 2%, at least 3%, at least 4%, at least 5%, at least 6%, at least 7%, at least 8%, at least 9%, at least 10%, at least 11%, at least 12%, at least 13%, at least 14%, at least 15%, at least 16%, at least 17%, at least 18%, at least 19%, at least 20%, at least 21%, at least 22%, at least 23%, at least 24%, at least 25%, at least 26%, at least 27%, at least 28%, at least 29%, at least 30%, at least 31%, at least 32%, at least 33%, at least 34%, at least 35%, at least 36%, at least 37%, at least 38%, at least 39%, at least 40%, at least 45%, at least 50%, at least 55%, at least 60%, at least 65%, at least 70%, at least 75%, at least 80%, at least 85%, or at least 90% of the anionic surfactant, based on a total weight of the active compounds.

In an exemplary embodiment, the treatment composition includes no more than 95% of the anionic surfactant, such as no more than 90%, no more than 85%, no more than 80%, no more than 75%, no more than 70%, no more than 65%, no more than 60%, no more than 55%, no more than 50%, no more than 45%, no more than 40%, no more than 39%, no more than 38%, no more than 37%, no more than 36%, no more than 35%, no more than 34%, no more than 33%, no more than 32%, no more than 31%, no more than 30%, no more than 29%, no more than 28%, no more than 27%, no more than 26%, no more than 25%, no more than 24%, no more than 23%, no more than 22%, no more than 21%, no more than 20%, no more than 19%, no more than 18%, no more than 17%, no more than 16%, no more than 15%, no more than 14%, no more than 13%, no more than 12%, no more than 11%, no more than 10%, no more than 9%, no more than 8%, no more than 7%, no more than 6%, no more than 5%, no more than 4%, no more than 3%, no more than 2%, or no more than 1%.

In an exemplary embodiment, the treatment composition includes 16.5% of the anionic surfactant, based on a total weight of the active compounds.

In certain embodiments, the described anionic surfactant is not present in the treatment composition.

Anionic Dispersant

An exemplary treatment composition includes a strongly anionic dispersant. The dispersant is a substance that improves the separation of colloidal particles suspended in solution to prevent agglomeration and deposition. In embodiments herein, the colloidal particles may be organic wood degradation components or inorganic crystalline salts, or mixtures thereof. It is envisioned that this formulation may solubilize hydrophobic materials into suspension with a surfactant, while holding particles separated from agglomeration and settling with a dispersant.

In certain embodiments, the anionic dispersant is an anionic sulfate or sulfonate dispersant. In exemplary embodiments, the anionic dispersant is an anionic sulfonate dispersant. In certain embodiments, the anionic dispersant is a sulfated/sulfonated polyaromatic compound. In certain embodiments, the anionic dispersant is sodium lignosulfonate.

In an exemplary embodiment, the anionic dispersant is a condensation polymer, such as a naphthalene sulfonate condensation polymer. Generally, condensation polymers may be graded by higher or lower degree of condensation and by content of more or less residual dissolved salts. In exemplary embodiments, the anionic dispersant is a low degree of condensation polymer and has a low level of residual salts.

A suitable anionic dispersant includes condensation products of aromatic sulfonic acids with formaldehyde, such as condensation products of formaldehyde and alkylnaphthalenesulfonic acids or of formaldehyde, naphthalenesulfonic acids, and/or benzenesulfonic acids, and condensation products of optionally substituted phenol with formaldehyde and sodium bisulfite. Dispersants from the group consisting of sulfosuccinic acid esters and alkylbenzenesulfonates are also suitable. Ligninsulfonates, for example, those which are obtained by the sulfite or Kraft process, are also particularly suitable. Such compounds may be products that are partly hydrolyzed, oxidized, propoxylated, sulfonated, sulfomethylated, or desulfonated and fractionated by known processes, for example, according to molecular weight or according to the degree of sulfonation.

An exemplary anionic dispersant may be selected from formaldehyde condensation products of alkyl naphthalene sulfonates, formaldehyde condensation products of beta-naphthalene sulfonate, polymerized formaldehyde naphthalene sodium sulfonate, and the like.

An exemplary anionic dispersant is formaldehyde/sodium naphthalene sulfonate condensation product.

In an exemplary embodiment, the anionic dispersant is a low molecular weight condensation product. For example, the anionic dispersant may have a molecular weight of less than 20,000 g/mole; such as less than 10,000 g/mole; less than 8,000 g/mole; less than 7,000 g/mole; or about 6,500 g/mole. The molecular weight can be used as an indication of the degree of condensation for these polymer types.

The low level of residual salts refers to how clean the final product is. In exemplary embodiments, the product is 2.5% residual sodium sulfate. This low level of residual salts is not critical to performance, but facilitates formulation.

An exemplary anionic dispersant is a naphthalenesulfonic acid condensation product, such as is commercially available as TAMOL NN9401 from BASF Corporation. Such product may have a naphthalenesulfonic acid content of 93.5%, a sodium sulfate content of 4.5%, and a formaldehyde content of less than 0.1%. Further, such a product may have an active content of 91%, a water content of 5%, and sodium sulfate content of 4%.

An exemplary anionic dispersant has the formula (II):

(II)

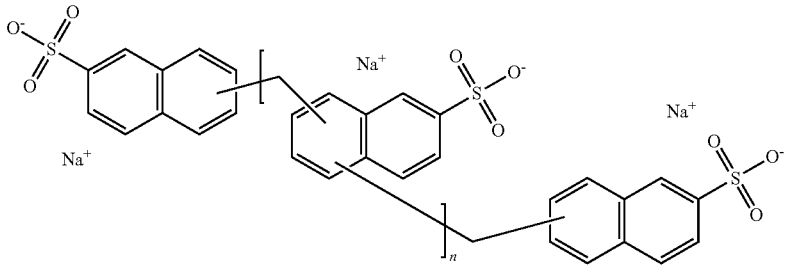

In certain embodiments, the treatment composition may include a single anionic dispersant. In other embodiments, the anionic dispersant may include a combination of more than one anionic dispersant.

In an exemplary embodiment, the treatment composition includes at least 1% of the anionic dispersant, such as at least 2%, at least 3%, at least 4%, at least 5%, at least 6%, at least 7%, at least 8%, at least 9%, at least 10%, at least 11%, at least 12%, at least 13%, at least 14%, at least 15%, at least 16%, at least 17%, at least 18%, at least 19%, at least 20%, at least 21%, at least 22%, at least 23%, at least 24%, at least 25%, at least 26%, at least 27%, at least 28%, at least 29%, at least 30%, at least 31%, at least 32%, at least 33%, at least 34%, at least 35%, at least 36%, at least 37%, at least 38%, at least 39%, at least 40%, at least 45%, at least 50%, at least 55%, at least 60%, at least 65%, at least 70%, at least 75%, at least 80%, at least 85%, or at least 90% of the anionic dispersant, based on a total weight of the active compounds.

In an exemplary embodiment, the treatment composition includes no more than 95% of the anionic dispersant, such as no more than 90%, no more than 85%, no more than 80%, no more than 75%, no more than 70%, no more than 65%, no more than 60%, no more than 55%, no more than 50%, no more than 45%, no more than 40%, no more than 39%, no more than 38%, no more than 37%, no more than 36%, no more than 35%, no more than 34%, no more than 33%, no more than 32%, no more than 31%, no more than 30%, no more than 29%, no more than 28%, no more than 27%, no more than 26%, no more than 25%, no more than 24%, no more than 23%, no more than 22%, no more than 21%, no more than 20%, no more than 19%, no more than 18%, no more than 17%, no more than 16%, no more than 15%, no more than 14%, no more than 13%, no more than 12%, no more than 11%, no more than 10%, no more than 9%, no more than 8%, no more than 7%, no more than 6%, no more than 5%, no more than 4%, no more than 3%, no more than 2%, or no more than 1%, based on a total weight of the active compounds.

In an exemplary embodiment, the treatment composition includes 67% of the anionic dispersant, based on a total weight of the active compounds.

Nonionic Alkoxylated Surfactant

An exemplary treatment composition includes a nonionic alkoxylated surfactant. For example, the nonionic alkoxylated surfactant may be a nonionic ethoxylated surfactant.

In certain embodiments, the nonionic alkoxylated surfactant can include ethylene oxide-propylene oxide (EO/PO) copolymers, EO polymers and copolymers, and nonionic extended chain surfactants having an EO group.

In exemplary embodiments, the nonionic alkoxylated surfactant is an ethoxylated EO/PO block copolymer surfactant. The copolymer surfactants can include capped EO/PO copolymer surfactants. Exemplary EO/PO copolymers and capped EO/PO copolymers are alkoxylated surfactants suitable for use in the compositions. EO/PO block copolymers include commercially-available Pluronic® and reverse Pluronic® surfactants and are examples of polymeric compounds made from a sequential propoxylation and ethoxylation. EO/PO copolymers can be modified by "capping" or "end blocking" the terminal hydroxy group or groups (of multi-functional moieties). In certain embodiments, the nonionic alkoxylated surfactant is Pluronic F108.

In certain embodiments, the nonionic alkoxylated surfactant includes (EO)n(PO)m(EO)n and (PO)m(EO)n(PO)m structures, wherein n and m are the average number of polymerized ethylene oxide and propylene oxide units, respectively, and can be calculated based on the percentage of EO/PO and molecular weight of a structures. In an aspect, the EO/PO block copolymer surfactants have a molecular weight of at least about 1000 g/mol, or at least about 2000 g/mol, or at least about 3000 g/mol, or at least about 4000 g/mol, or at least about 5000 g/mol, or at least about 6000 g/mol, or at least about 7000 g/mol, or at least about 8000 g/mol, or at least about 9000 g/mol, or at least about 10,000 g/mol, or at least about 11,000 g/mol, or at least about 12,000 g/mol, or at least about 13,000 g/mol, or at least about 14,000 g/mol, or at least about 15,000 g/mol.

In certain embodiments, the EO/PO block copolymer surfactants and capped EO/PO block copolymer surfactants have at least about 20% EO, at least about 30% EO, at least about 40% EO, at least about 50% EO, at least about 60% EO, at least about 70% EO, at least about 80% EO, or at least about 90% EO, and with a Ross Miles Foam of greater than or equal to 40 (0.1% @ 50° C.). Exemplary EO/PO block copolymers are commercially available under the tradename Pluronic®.

Block poly oxypropylene-polyoxy ethylene polymeric compounds may be based upon propylene glycol, ethylene glycol, glycerol, trimethylolpropane, and ethylenediamine as the initiator reactive hydrogen compound. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule. Beneficially, Pluronic® compounds provide 100% actives. In an aspect, the propoxylated polymers can include PO polymers. PO polymers, PO-EO polymers and EO-PO polymers derived from polyethyleneimine (PEI) polymers, including PEI-PO, PEI-PO-EO, PEI-EO-PO and their salts or mixtures thereof. The PEI or PEIs are branched, spherical polymeric amines, and the molecular weight of the PEI or PEI salt used is from about 800 Daltons to about 2 million Daltons. In addition, the charge density of the PEI or PEI salt used is from about 15 meq/g to about 25 meq/g, such as from about 16 meq/g to about 20 meq/g. Examples of such PEIs include the BASF products LUPASOL WF (25 kDa; 16-20 meq/g) and Lupasol FG (800 daltons; 16-20 meq/g), and the SOKALAN family of polymers available from BASF.

In certain embodiments, the alkoxylated surfactants can include one or more extended chain surfactants. These are surfactants that have, for example, an intermediate polarity polypropylene oxide chain (or linker) inserted between the lipophilic tail group and hydrophilic polar head. Examples of lipophilic tails groups may include hydrocarbons or alkyl ethers. Examples of anionic and nonionic hydrophilic polar heads of the extended surfactant include, but are not necessarily limited to, groups such as polyoxyethylene sulfate, ethoxysulfate, carboxylate, ethoxy-carboxylate, C6 sugar, xylitol, di-xylitol, ethoxy-xylitol, carboxylate and xytol, carboxylate and glucose.

In an exemplary embodiment, the nonionic alkoxylated surfactant is a low molecular weight EO/PO/EO block copolymer surfactant. An exemplary nonionic alkoxylated surfactant is a glycerol initiated EO/PO block copolymer PO terminated, i.e., a glycerol branched EO/PO side chain surfactant. Such a surfactant is commercially available as DOWFAX DF 114 from Dow Chemical. An exemplary low molecular weight EO/PO/EO block copolymer surfactant may have the formula (III):

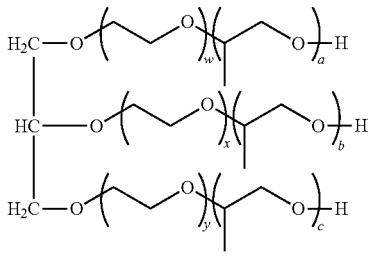

In an exemplary embodiment, the nonionic alkoxylated surfactant has EO/PO polymer side chains.

In certain embodiments, the nonionic alkoxylated surfactant is a linear ethoxylate oil. An exemplary linear ethoxylate oil has 22 to 40 EO units.

The nonionic alkoxylated surfactant may be selected from the group consisting of alkoxylated plant oils, plant fats, animal oils, animal fats, and mixtures thereof. The non-ionic surfactant can have a Hydrophilic-Lipophilic Balance (HLB) value of 6 or greater, or 8 or greater, or 10 or greater, or 11 or greater, or 12 or greater, or 13 or greater, or 14 or greater, or 15 or greater, or 16 or greater.

The term "alkoxylated" is used herein as an adjective that describes a material as having been a reactant in a chemical reaction during which alkoxy groups were added to the material. An alkoxy functional group (or alkyl oxide) is an alkyl group singular bonded to oxygen. The simplest alkoxy groups are methoxy ($CH_3O$—), ethoxy ($CH_3CH_2O$—), propoxy ($CH_3CH_2CH_2O$—), and isopropoxy. The general form of an ethoxylation reaction is given as: $ROH+n\ C_2H_4O \rightarrow R(OC_2H_4)_nOH$. A polyoxyethylene group would have repeat units of oxyethylene (—$OC_2H_4$—) and is formed in an ethoxylation reaction using ethyl oxide.

An exemplary nonionic alkoxylated surfactant is castor oil EO alkoxylate having a total of 22 to 40 EO units.

Various oils or fats can be used in an alkoxylation reaction to produce the alkoxylated surfactant, including without limitation castor oil, soybean oil, palm kernel oil, almond oil, corn oil, canola oil, rapeseed oil, and coconut oil, tallow, lard, white grease, and yellow grease. In certain embodiments, the non-ionic surfactant of the demulsifying composition may be ethoxylated castor oil, ethoxylated soybean oil, ethoxylated palm kernel oil, ethoxylated almond oil, ethoxylated corn oil, ethoxylated canola oil, ethoxylated rapeseed oil, or ethoxylated coconut oil. The surfactant may have an average degree of alkoxylation in a range of from 22 to 40 moles of alkoxylation per mole of oil.

In one non-limiting example, the alkoxylated surfactant is ethoxylated castor oil having an average degree of ethoxylation in a range of 22 moles to 40 moles of ethoxylation per mole of castor oil. Castor oil is a triester of glycerol and fatty acid chains where the average composition of the fatty acid chains is: ricinoleic acid 85-95%; oleic acid 2-6%; linoleic acid 1-5%; α-linolenic acid 0.5-1%; stearic acid 0.5-1%; palmitic acid 0.5-1%; dihydroxystearic acid 0.3-0.5%; and other fatty acids 0.2-0.5%

In certain embodiments, the treatment composition may include a single nonionic alkoxylated surfactant. In other embodiments, the nonionic alkoxylated surfactant may include a combination of more than one nonionic alkoxylated surfactant.

In an exemplary embodiment, the treatment composition includes at least 1% of the nonionic alkoxylated surfactant, such as at least 2%, at least 3%, at least 4%, at least 5%, at least 6%, at least 7%, at least 8%, at least 9%, at least 10%, at least 11%, at least 12%, at least 13%, at least 14%, at least 15%, at least 16%, at least 17%, at least 18%, at least 19%, at least 20%, at least 21%, at least 22%, at least 23%, at least 24%, at least 25%, at least 26%, at least 27%, at least 28%, at least 29%, at least 30%, at least 31%, at least 32%, at least 33%, at least 34%, at least 35%, at least 36%, at least 37%, at least 38%, at least 39%, at least 40%, at least 45%, at least 50%, at least 55%, at least 60%, at least 65%, at least 70%, at least 75%, at least 80%, at least 85%, or at least 90% of the nonionic alkoxylated surfactant, based on a total weight of the active compounds.

In an exemplary embodiment, the treatment composition includes no more than 95% of the nonionic alkoxylated surfactant, such as no more than 90%, no more than 85%, no more than 80%, no more than 75%, no more than 70%, no more than 65%, no more than 60%, no more than 55%, no more than 50%, no more than 45%, no more than 40%, no more than 39%, no more than 38%, no more than 37%, no more than 36%, no more than 35%, no more than 34%, no more than 33%, no more than 32%, no more than 31%, no more than 30%, no more than 29%, no more than 28%, no more than 27%, no more than 26%, no more than 25%, no more than 24%, no more than 23%, no more than 22%, no more than 21%, no more than 20%, no more than 19%, no more than 18%, no more than 17%, no more than 16%, no more than 15%, no more than 14%, no more than 13%, no more than 12%, no more than 11%, no more than 10%, no more than 9%, no more than 8%, no more than 7%, no more than 6%, no more than 5%, no more than 4%, no more than 3%, no more than 2%, or no more than 1%, based on a total weight of the active compounds.

In an exemplary embodiment, the treatment composition includes 16.5% of the nonionic alkoxylated surfactant, based on a total weight of the active compounds.

Treatment Agent

In exemplary embodiments, the described composition forms the active compounds in a treatment agent for application to black liquor. An exemplary treatment agent includes water and the active compounds.

An exemplary treatment agent includes at least 30% water, such as at least 40%, at least 50%, at least 60%, at least 70% water, at least 80% water, or at least 90% water, based on the total weight of the treatment agent.

An exemplary treatment agent includes at least 10% active compounds, such as at least 20%, at least 30%, at least 40%, at least 50%, at least 60%, or at least 70% active compounds, based on the total weight of the treatment agent.

Method OF Treatment

In an exemplary embodiment, a method for treating a black liquor includes adding an effective amount of a composition to the black liquor. In exemplary embodiments, the effective amount is added to the black liquor when the black liquor is in a last evaporator, or evaporator stage, of a sequence of evaporators, or evaporator stages. In exemplary embodiments, the effective amount is added when the evaporative concentration of the black liquor, or pulping spent liquor, has a dissolved solids concentration is of from 40 to 60% by weight, such as from 45 to 60% by weight, 48 to 60% by weight, 49 to 60% by weight, or 50 to 60% by weight.

In exemplary embodiments, the effective amount is added when the black liquor has a pH of greater than 12 and is at a temperature of greater than 120° C.

In exemplary embodiments, the effective amount is from 25 to 5,000 ppm actives on a black liquor solids basis or from 25 grams to 5 kilograms actives on a megaton of black liquor solids basis. In certain embodiments, the effective amount is at least 25, such as at least 50, at least 75, at least 100, or at least 125 ppm actives on a black liquor solids basis. In certain embodiments, the effective amount is at most 500, such as at most 450, at most 400, at most 350, at most 300, or at most 250 ppm actives on a black liquor solids basis.

Addition of the described treatment composition has been found to minimize fouling and/or reduce the viscosity of the black liquor.

EXAMPLES

Example 1

A first test was performed to determine a viscosity reduction through use of an anionic surfactant such as DOWFAX 2A1 (sodium tetrapropyl diphenyloxide disulfonate).

Hardwood Kraft black liquor procured from Pixelle Specialty Solutions, Spring Grove, PA was heated to evaporate water until the concentration reached 50%, 55%, and 60% solids by weight. A 25 mL sample was placed in a standard Brookfield LV Viscometer using a circulating heated control bath sample holder to keep the temperature at 75° C. during testing. Brookfield viscosity was measured with a #1 spindle at an rpm setting sufficient to generate 50-55% torque. Stable viscosity measurement was repeated 5 times and averaged.

Individual compounds were screened by dosing the unused sample residual after the blank measurement sample was removed, measured, and discarded, i.e. the treated and untreated were the same BL. The compounds were tested at dosages of 125, 250, and 500 ppm/MT BL solids basis on BL samples at 50, 55, and 60% solids by weight. Unexpectedly, Dow Gemini surfactant Dowfax 2A1 reduced solution viscosity at the higher 250 and 500 ppm doses (as shown in FIG. 1). Other nonionic and anionic surfactants had been unsuccessful in this testing, and known successful additives required impractical doses, such as 100 times larger (such by using thiocyanate salts at 60 kg/MT or mixed glycols at 60 kg/MT). High boiling solvent dimethylformamide (DMF) and dispersant solvent glycol ether dipropyl methyl ether (DPME) required 30 kg/MT (a 60 times higher dosage) to lower viscosity.

Example 2

Figure 2:
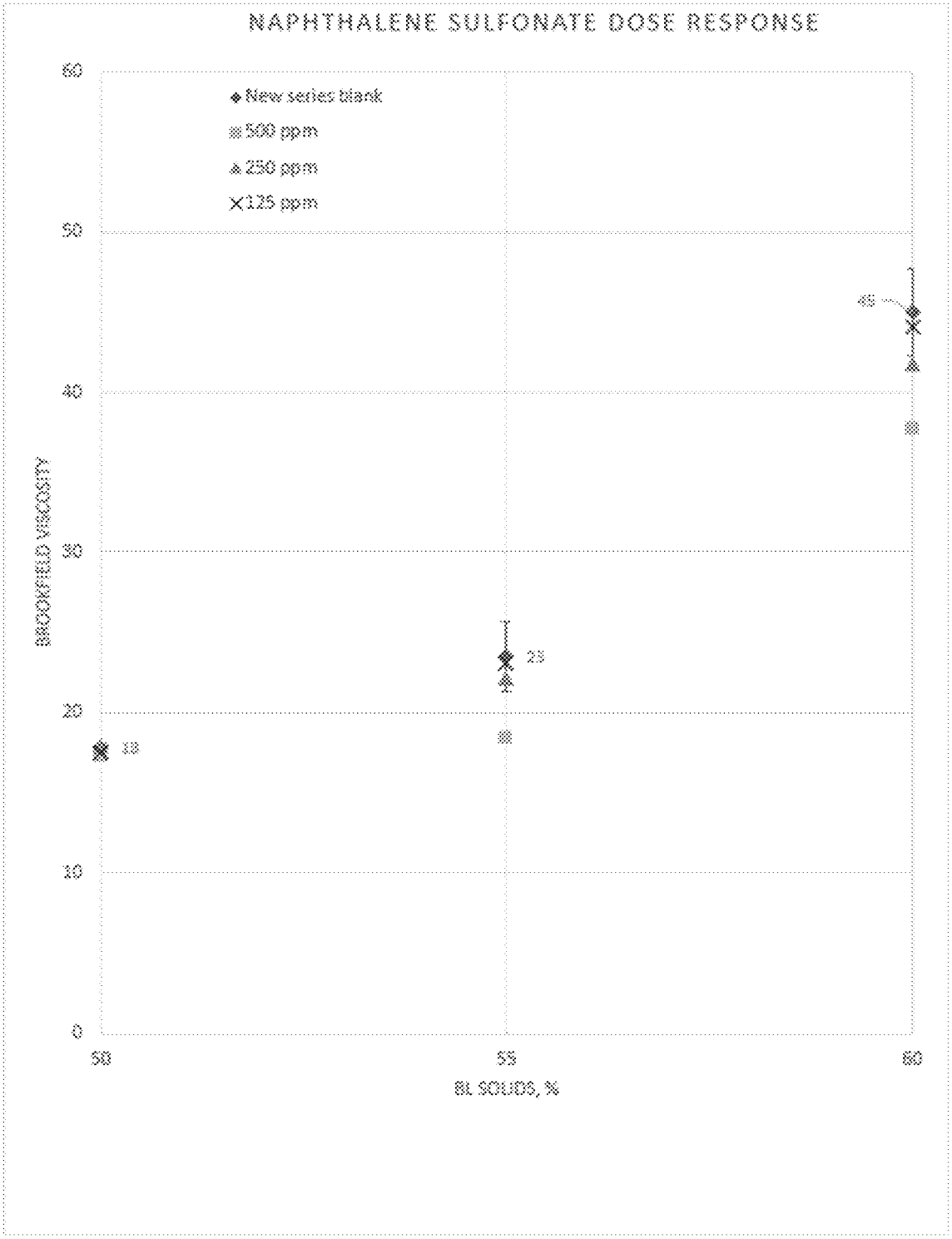
FIG. 2 is a graph illustrating a reduction in viscosity of a black liquor when treated with an anionic dispersant such as a naphthalene sulfonate condensation polymer.

A second test was performed to determine a viscosity reduction through use of an anionic dispersant such as a naphthalene sulfonate condensation polymer. As shown in FIG. 2, viscosity was reduced as measured at 250 ppm and 500 ppm.

Example 3

Figure 3:
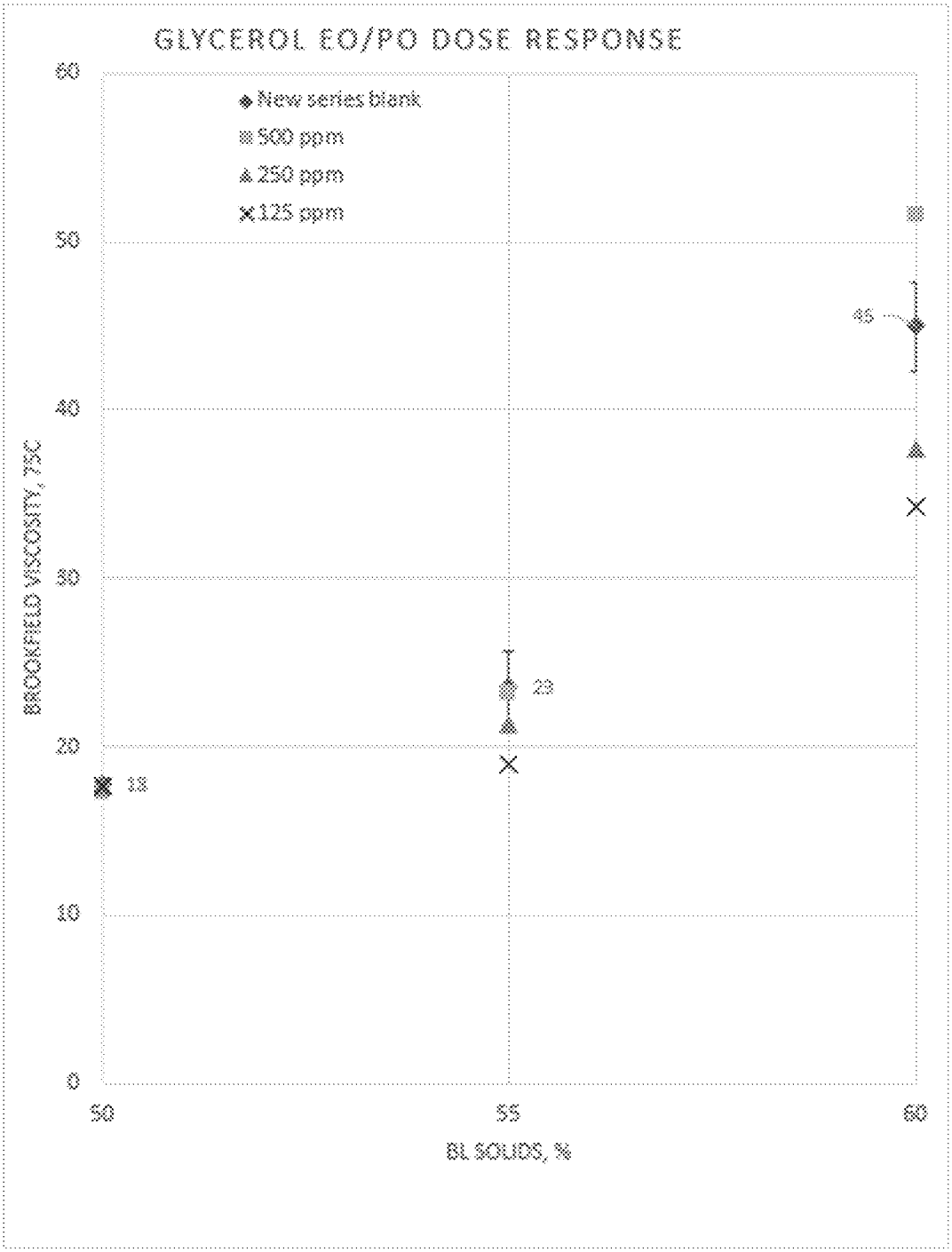
FIG. 3 is a graph illustrating a reduction in viscosity of a black liquor when treated with a nonionic alkoxylated surfactant, such as glycerol with side chain copolymers of ethylene oxide/propylene oxide.

A third test was performed to determine a viscosity reduction through use of a nonionic alkoxylated surfactant, such as glycerol with side chain copolymers of ethylene oxide/propylene oxide (Dowfax DF114). As shown in FIG. 3, viscosity was reduced at the lower ppm addition amounts.

Example 4

Figure 4:
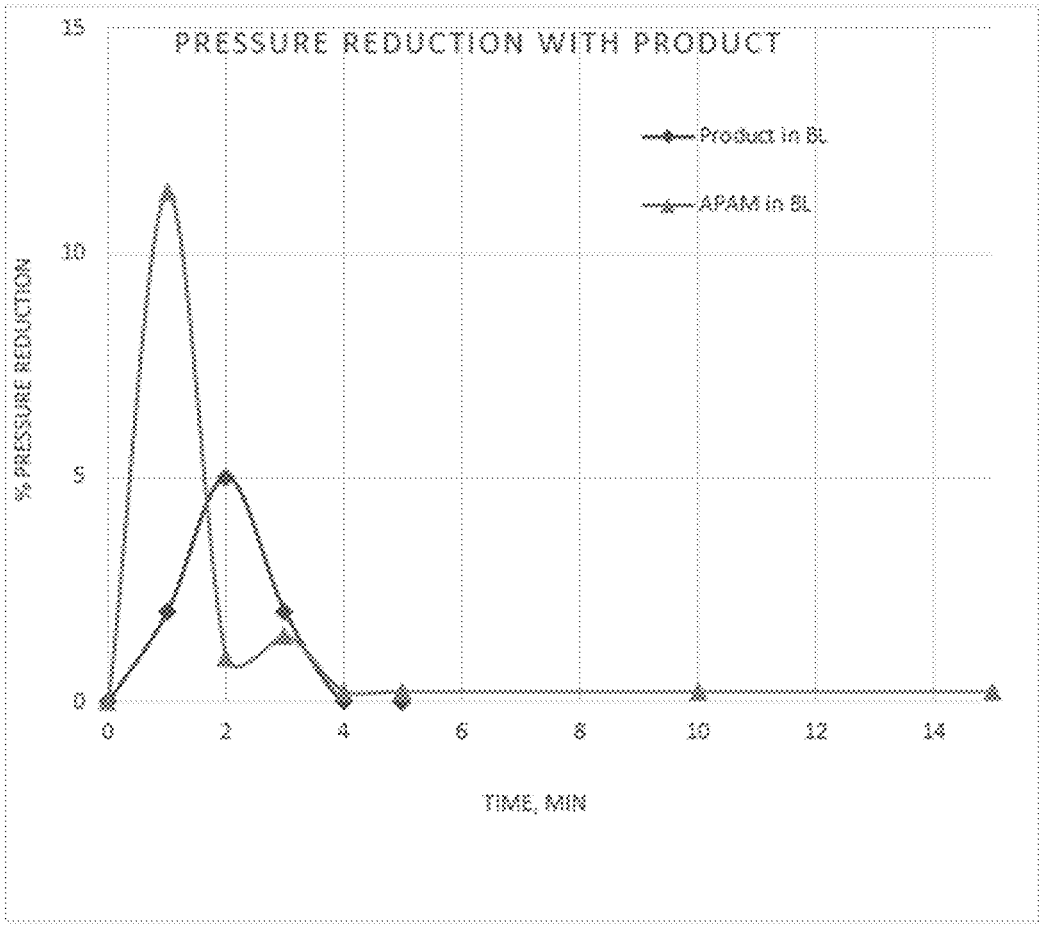
FIG. 4 is a graph illustrating a cost savings for pumping energy of an evaporator circuit due to friction reduction provided by treating the black liquor with a product including sodium tetrapropyl diphenyloxide disulfonate, naphthalenesulfonic acid condensation product, and glycerol with side chain copolymers of ethylene oxide/propylene oxide.

A fourth test was performed to determine cost savings for pumping energy of an evaporator circuit due to friction reduction provided by the addition of a product including 16.5% sodium tetrapropyl diphenyloxide disulfonate (Dowfax 2A1), 67% naphthalenesulfonic acid condensation product (TAMOL NN9401), and 16.5% glycerol with side chain copolymers of ethylene oxide/propylene oxide (Dowfax DF114), all by a total weight. Testing results are shown in FIG. 4.

The reduction of viscosity in the black liquor solution may be measured as a decrease in the pressure reading $\Delta P$ between two points in a pipe where the liquor is being pumped at high turbulence. This $\Delta P$ may be due to reduction in friction between the solution and the pipe wall and between dissolved particles in solution.

A "Friction Loop" apparatus was constructed in which hot concentrated black liquor may be circulated around a pipe loop utilizing a pump. Pressure gauges are located inline at fixed intervals to measure the drop in pressure due to friction of the liquid against the walls of the pipe. Black liquor of 40% solids was circulated at a fixed pump speed and 50° C. Injection of the product into the process stream resulted in a small pressure drop (chart below). This is a modest outcome, the effect is very short lived, but indicates that the product does not have a negative effect on the pipe friction. This is evidence suggesting that there will not be any complicating effect on the evaporator circulation system. A comparable performance was observed for a developmental Solenis APAM emulsion used in hydraulic fracturing fluids. The performance is much lower in BL than in that system, likely due to the harsher chemical environment of the application (very high pH, sulfidity, solids, and temperature).

Example 5

A fifth test was performed to determine a reduction in the rate of scale formation on steel surfaces by a black liquor provided by the addition of a product including 16.5% sodium tetrapropyl diphenyloxide disulfonate (Dowfax 2A1), 67% naphthalenesulfonic acid condensation product (TAMOL NN9401), and 16.5% glycerol with side chain copolymers of ethylene oxide/propylene oxide (Dowfax DF114), all by a total weight.

The combination of $Na_2SO_4$ and $Na_2CO_3$ in Kraft black liquor forms soluble scale (typically Burkeite) in the pulp mill evaporation system, which combined with less soluble lignin, degraded carbohydrates, and wood extractives can form layers that foul the evaporator surface and decrease the heat transfer efficiency.

Figure 5:
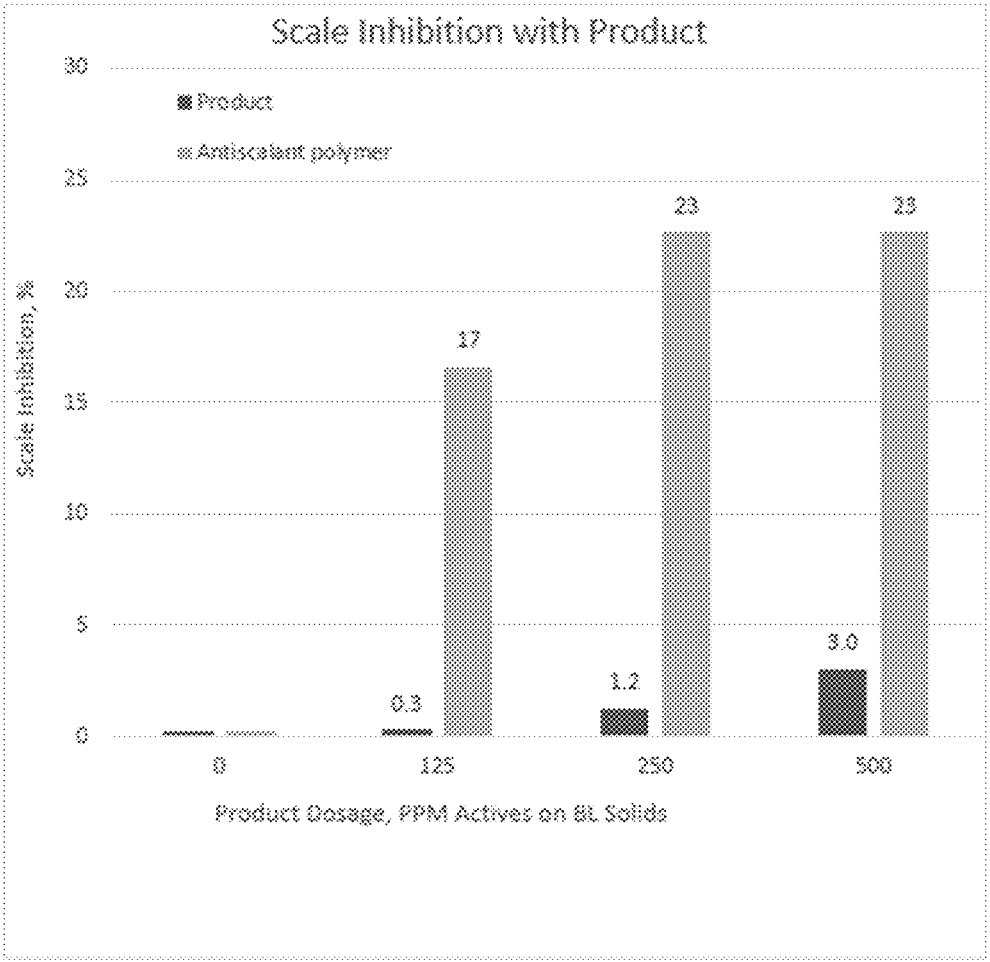
FIG. 5 is a graph illustrating a reduction in the rate of scale formation on steel surfaces by a black liquor treated with a product including sodium tetrapropyl diphenyloxide disulfonate, naphthalenesulfonic acid condensation product, and glycerol with side chain copolymers of ethylene oxide/propylene oxide.

A scale measuring apparatus was constructed using stainless steel autoclaves lying horizontally in a roller oven. Kraft black liquor with 15% solids was augmented with $Na_2SO_4$ and $Na_2CO_3$ to raise the solids content to 55%, treated with the additive product, added to the autoclaves, and heated to 120° C. for 4 hours while rotating at a steady speed to simulate a falling film evaporator. At the conclusion of the experiment the autoclaves were cooled, acclimated to 35° C. in a water bath, and the liquor was decanted out leaving the scale behind adhered to the vessel walls. The vessels were oven dried and weighed to determine the amount of scale gravimetrically. The product treated samples were compared to untreated blanks to determine the % scale inhibition due to the product (as shown in FIG. 5). The product showed a positive outcome, inhibiting an amount of the scaling. This is evidence suggesting that there may not be any complicating effect on the evaporator circulation system due to scaling. The effect of a scale inhibiting polymer product is shown for comparison purposes (it has been shown in previous studies that this polymer dosage is much too high for practical or economic reasons, but it validates the test apparatus).

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A composition comprising:

black liquor;

an anionic sulfate or sulfonate surfactant;

an anionic sulfate or sulfonate dispersant; and a nonionic alkoxylated surfactant.

2. The composition of claim 1, wherein the anionic sulfate or sulfonate surfactant is selected from sodium xylene sulfonate, di-phenyl sulfonate gemini surfactant, and combinations thereof.

3. The composition of claim 1, wherein the anionic sulfate or sulfonate surfactant comprises an alkyldiphenyloxide disulfonate.

4. The composition of claim 1, wherein the anionic sulfate or sulfonate dispersant comprises a naphthalene sulfonate condensation polymer or a sodium lignosulfonate.

5. The composition of claim 1, wherein the nonionic alkoxylated surfactant is selected from ethylene oxide-propylene oxide (EO/PO) block copolymer surfactants, EO/PO/EO block copolymer surfactants, and linear ethoxylate [castor] oil.

6. The composition of claim 1, wherein the nonionic alkoxylated surfactant comprises glycerol initiated EO/PO side chain surfactant.

7. The composition of claim 1, wherein:

the anionic sulfate or sulfonate surfactant comprises an alkyldiphenyloxide disulfonate;

the anionic sulfate or sulfonate dispersant comprises a naphthalene sulfonate condensation polymer; and the nonionic alkoxylated surfactant comprises glycerol branched EO/PO side chain surfactant.

8. The composition of claim 7, wherein the anionic sulfate or sulfonate surfactant; the anionic sulfate or sulfonate dispersant; and the nonionic alkoxylated surfactant form a black liquor treatment agent, and wherein the black liquor treatment agent consists essentially of carbon atoms, hydrogen atoms, oxygen atoms, sulfur atoms, and sodium atoms.

9. The composition of claim 1, wherein the anionic sulfate or sulfonate surfactant; the anionic sulfate or sulfonate dispersant; and the nonionic alkoxylated surfactant form a black liquor treatment agent, and wherein the black liquor treatment agent is free of nitrogen-containing compounds and phosphorus-containing compounds.

10. The composition of claim 1, wherein the anionic sulfate or sulfonate surfactant; the anionic sulfate or sulfonate dispersant; and the nonionic alkoxylated surfactant form a black liquor treatment agent, and wherein the black liquor treatment agent consists essentially of carbon atoms, hydrogen atoms, oxygen atoms, sulfur atoms, and sodium atoms.

11. The composition of claim 1, wherein the black liquor has a solids content of 40-60% by weight.

12. The composition of claim 1, wherein the black liquor has a solids content of 50-60% by weight.

13. A method for treating a black liquor, the method comprising:

adding an effective amount of a composition to the black liquor; and minimizing fouling and/or reducing the viscosity of the black liquor, wherein the composition comprises:

an anionic sulfate or sulfonate surfactant;

an anionic sulfate or sulfonate dispersant; and a nonionic ethoxylated surfactant.

* * * * *